US005734351A

United States Patent [19]

Ojantakanen et al.

[11] Patent Number: 5,734,351

[45] Date of Patent: Mar. 31, 1998

[54] DOUBLE-ACTION ANTENNA

[75] Inventors: Seppo Ojantakanen, Paavola; Seppo Raatikainen, Kempele; Petteri Annamaa; Tero Haapamaki, both of Oulu, all of Finland

[73] Assignee: LK-Products Oy, Kempele, Finland

[21] Appl. No.: 654,687

[22] Filed: May 29, 1996

[30] Foreign Application Priority Data

Jun. 5, 1995 [FI] Finland ..... 952742

[51] Int. Cl.[6] ..... H01Q 1/24

[52] U.S. Cl. ..... 343/702; 343/892; 343/900

[58] Field of Search ..... 343/702, 895, 343/900, 901, 906; H01Q 1/24

[56] References Cited

U.S. PATENT DOCUMENTS

| | | | |
|---|---|---|---|
| 4,868,576 | 9/1989 | Johnson, Jr. | 343/700 |
| 5,446,469 | 8/1995 | Makino | 343/702 |

FOREIGN PATENT DOCUMENTS

| | | | |
|---|---|---|---|
| 0 511 577 A3 | 11/1992 | European Pat. Off. | H01Q 1/24 |
| 0 644 606 A1 | 3/1995 | European Pat. Off. . | |
| 0 660 440 A1 | 6/1995 | European Pat. Off. . | |
| 0 650 215 A3 | 11/1995 | European Pat. Off. | H01Q 5/00 |
| 952406 | 5/1995 | Finland . | |
| 2 253 949 | 9/1992 | Germany | H01Q 1/08 |
| 2 500 331 | 6/1994 | Sweden . | |
| 2 284 101 | 5/1995 | United Kingdom . | |
| WO94/10720 | 5/1994 | WIPO . | |
| WO95/08853 | 3/1995 | WIPO . | |
| WO95/12224 | 5/1995 | WIPO . | |
| WO96/00990 | 1/1996 | WIPO . | |

*Primary Examiner*—Hoanganh T. Le
*Attorney, Agent, or Firm*—Darby & Darby

[57] ABSTRACT

The invention relates to a double-action, two-piece antenna structure whose first antenna part, preferably a helix antenna (1), is fixedly connected to the antenna port of a radio communications set, and the second antenna port, preferably a rod antenna (2), is movable with respect to the first antenna part. In an active position, the second antenna part (2) is coupled to the first antenna part (1), forming a serial connection whose electrical length is as great as or greater than the electrical length of the first antenna part alone.

12 Claims, 7 Drawing Sheets

Figure 5A:
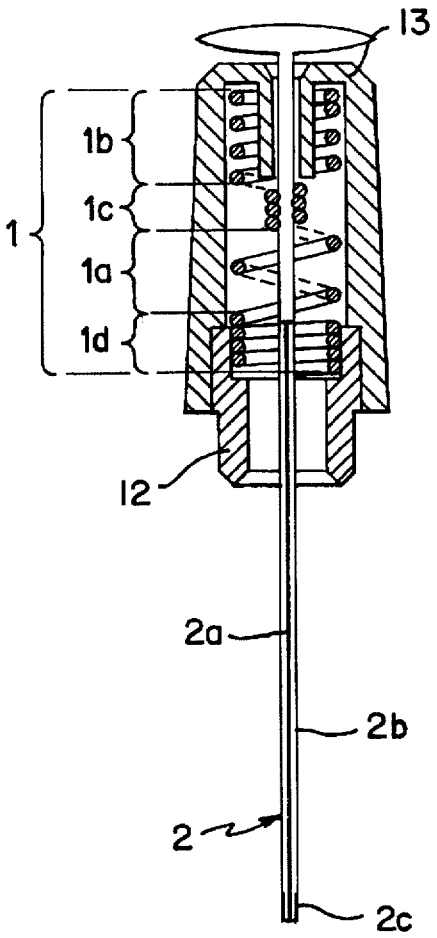

FIG. 1a
PRIOR ART
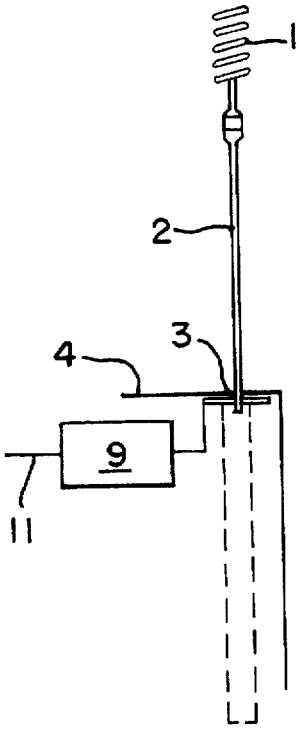
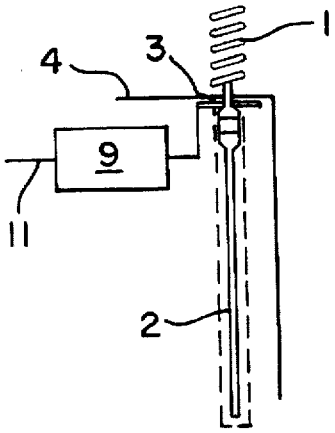
FIG. 1b
PRIOR ART
FIG. 2a
PRIOR ART
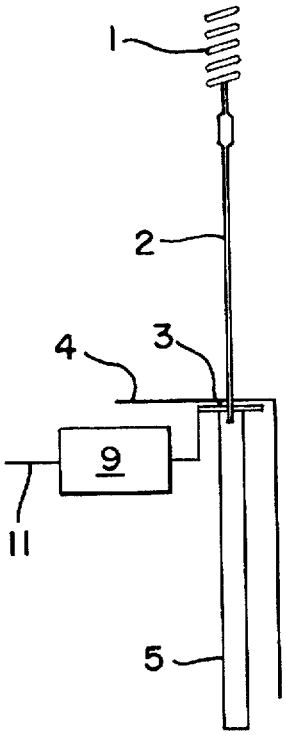
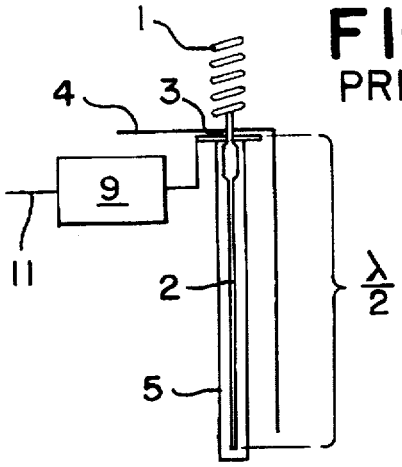
FIG. 2b
PRIOR ART FIG. 3a
PRIOR ART
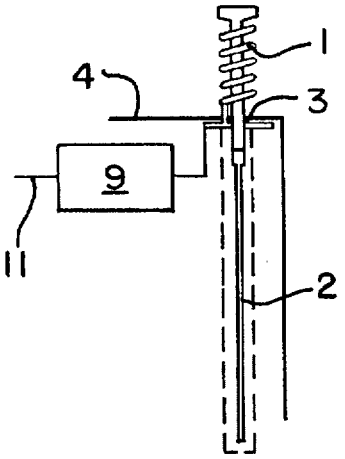
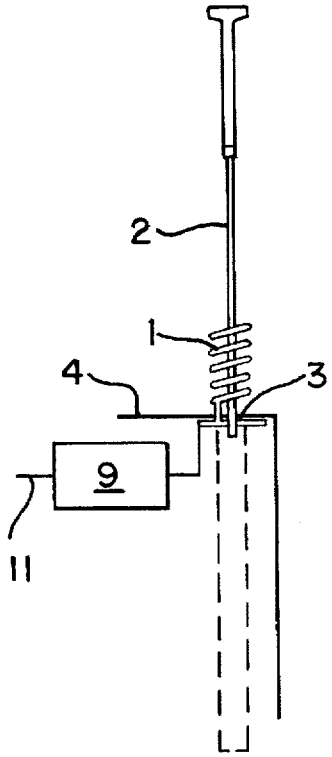
FIG. 3b
PRIOR ART
FIG. 4a
PRIOR ART
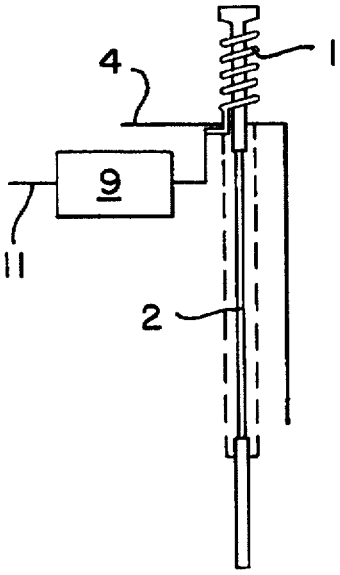
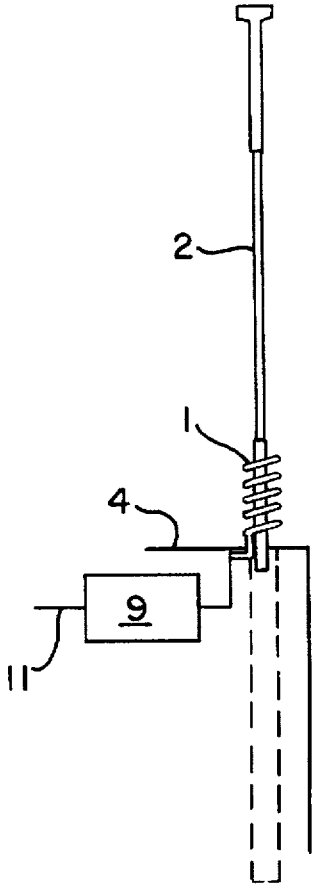
FIG. 4b
PRIOR ART

DOUBLE-ACTION ANTENNA

The invention relates to an omnidirectional antenna intended for radio frequencies, which can be pushed partly inside the case of a radio set to save space and which operates as an antenna both when pushed in and pulled out.

The development of portable data transmission devices has resulted in a trend in which transceivers, such as mobile phones which operate on radio frequencies, are made increasingly smaller and lighter. This sets great demands on antenna structures because users assume that antennas do not considerably increase the outer dimensions of otherwise small radio sets, especially when the device is not in use but is carried, e.g., in one's pocket or briefcase. On the other hand, the fluency and reliability of telecommunications links require that antennas possess good electrical properties, and a mobile station in a portable position should also be able to receive calls transmitted by a base station. More accurate information about messages and power levels, which should be transmitted and received by an antenna, are included in the specifications of each data transmission system, an example of which is the specification of the GSM system mentioned in publication "M.R.L. Hodges, The GSM radio interface, British Telecom Technological Journal", Vol. 8. No 1, No 1, 1990. pp. 31–43.

In the following, a mobile phone is examined as an example of a radio set but the examination also applies on a more general level of transceivers, for which requirements are presented concerning both size and operation. A general solution is to provide the mobile phone with a double-action antenna which is mainly pushed inside the case of the telephone during the transportation and storage position, and which can be pulled out by the user when necessary. These two positions are called the "passive position" and the "active position". The antenna is constructed so that an operating part of the antenna remains outside the telephone case also in the passive position, through which the telephone is able to receive call messages. However, the electric performance of the antenna is much better in the active position, so in order to achieve a successful telephone connection, the user should pull the antenna into the active position when starting a call.

One double-action antenna solution is disclosed in U.S. Pat. No. 5,204,687. In this solution, the double-action antenna comprises, according to FIGS. 1*a* and 1*b*, two conducting antenna elements which are placed sequentially in an elongated antenna structure without a mutual, electrically transmitted connection. The top of the antenna comprises a conductor which is wound into a cylindrical coil, i.e., the so-called helix part 1, which, in the longitudinal direction of the antenna, is essentially shorter than a straight conductor, so-called rod part 2 which functions as the arm of the antenna. While the antenna is in the active position (FIG. 1*a*), the transceiver unit of the telephone is coupled to its lower end through sliding coupling 3 and it uses only the rod part as an antenna. In the passive position (FIG. 1*b*), rod part 2 is fully pushed inside case 4 of the telephone and the transceiver unit is coupled to helix part 1 through the "neck" of the antenna. Matching circuit 9 matches the respective impedance of the antenna to correspond to the impedance of antenna port 11 of the radio set. One drawback in this arrangement is that since the rod and the helix parts are not in electric contact with one another, while one part is active, the other one is redundant in a way. Such an arrangement does not save very much space.

One antenna solution, which has been used in portable radio sets for a long time, is a telescopic antenna which comprises nested, cylindrical elements which slide with respect to one another. The telescopic structure is expensive and relatively difficult to manufacture and it does not tolerate mechanical stress very well, therefore, it has not been particularly successful in mobile phones.

Patent publication WO 92/16980 presents a double-action antenna solution according to FIGS. 2*a* and 2*b*, comprising, in a similar manner as in the antenna presented in publication U.S. Pat. No. 5,204,687, sequential helix 1 and rod 2 parts which, in this case, are interconnected by using an electrically conductive connection. The idea of the invention is to dimension the rod part 2 and its push-in case 5 so that in the passive position (FIG. 2*b*) the rod part is seen toward the helix part as a very high impedance and does not effect the operation of the helix part as an antenna. An incorrectly dimensioned rod part would cause undesired reflections or unnecessary attenuation on signals when pushed inside. In the structure of publication WO 92/16980, rod part 2 is preferably dimensioned into a length of half a wavelength. Half of the wavelength is about 30 cm on a frequency of 450 MHz and about 15 cm on a frequency of 900 MHz, therefore, the rod part of half a wavelength according to publication WO 92/16980 is still fairly long for modern mobile phones. It is obvious that even shorter solutions in antenna structures should be reached.

In addition to the said drawbacks, the problem with the above-described double-action antenna structures is that if the antenna is not in either one of the extreme positions, no radiating element is coupled to the antenna port of the transceiver circuit of the radio set. If this is not taken into account when designing the antenna structure, the antenna port is seen as an open terminal in the transceiver circuit direction, whereby a major part of the transmitter power is reflected back to the transceiver circuit from the antenna port.

A solution to the latter problem is known from publications WO 94/10720 (FIGS. 3*a* and 3*b*) and U.S. Pat. No. 4,868,576 (FIGS. 4*a* and 4*b*), in which only one antenna element 2 is movable and the other antenna element, the helix element 1 in the solutions disclosed, is attached to the body 4 of the radio set and coupled permanently to antenna port 11 of the transceiver circuit through matching circuit 9. When the mobile antenna element 2 is pushed in, i.e., into the passive position, only the fixed antenna element 1 is used as the antenna. In the active position, the mobile antenna element 2 is switched on either electromagnetically, as in publication U.S. Pat. No. 4,868,576 (FIG. 4*b*), or galvanically through sliding coupling 3, as in publication WO 94/10720 (FIG. 3*b*), in which the both antenna elements are coupled in parallel to antenna port 11 through matching circuit 9. In these antenna arrangements, mobile antenna element 2 must also be provided with a length of half a wavelength to ensure sufficient electric performance, which was stated above as being impractical with respect to modern mobile phones.

The object of the invention is to provide an antenna structure which operates when retracted, when partly pulled out, and when completely pulled out, in a manner required by a data transmission system, preferably a mobile phone system, and which is very small in size. The structure should be simple to manufacture and should, with respect to manufacturing costs, be well-adapted to mass production of mobile stations.

The object is achieved by using an antenna arrangement comprising a first antenna part, preferably a helix part, and a second antenna part, preferably a rod part, of which the first antenna part is fixed to the antenna port of a radio set and the second antenna part moves, with respect to the first antenna part, between two extreme positions, forming a serial connection with the first part in one of the positions.

The antenna structure according to the invention is characterized in that in relation to the first antenna part, the second antenna part can be moved into a position where it is coupled to the first antenna part at a point between the first and second ends of the first antenna part, forming a series connection, which couples to the antenna port of the radio set, with at least that portion of the first antenna part which is between the said point and the said first end.

The invention is based on the idea of coupling, in the active position, the second part of the antenna as an extension of the first part, whereby they form a series connection. The first part is preferably a conductor wound into a cylindrical coil, i.e., a helix antenna, and the second part is preferably a straight conductor, i.e., a rod antenna. When connected in series, they form a rod antenna shortened by an inductance (coil) which, in the direction of the longitudinal axis of the antenna structure, is shorter than the straight rod antenna of a corresponding electrical length. The helix antenna or a part thereof, which is connected between the antenna port and the rod antenna, can be called a shortening coil in such an arrangement. When the mobile rod antenna is in the passive position or between the extreme positions, only the helix antenna is used as the antenna.

Figure 5B:
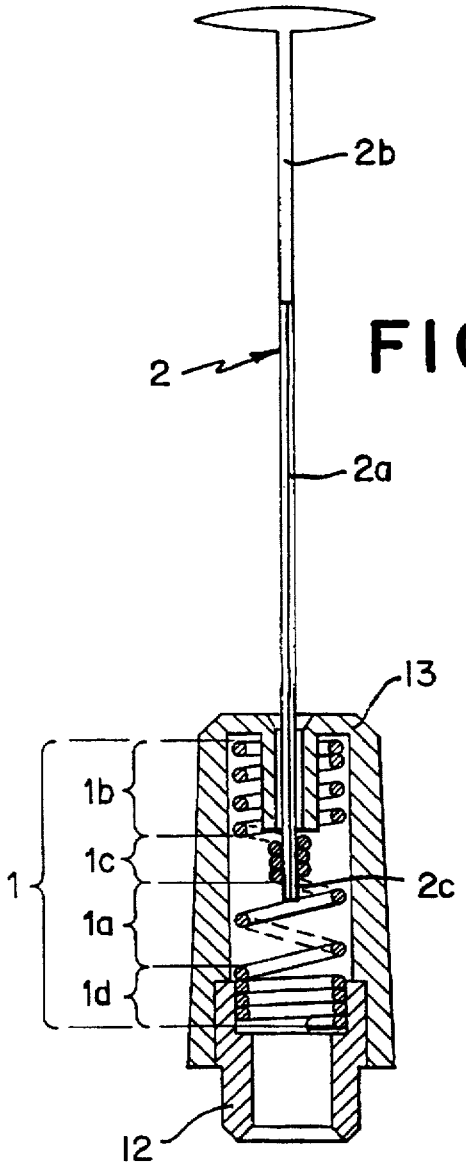
Figure 6A:
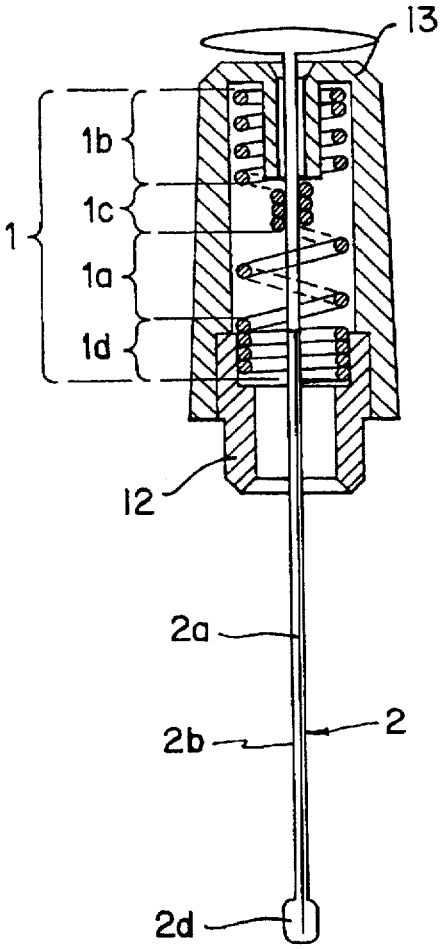
Figure 6B:
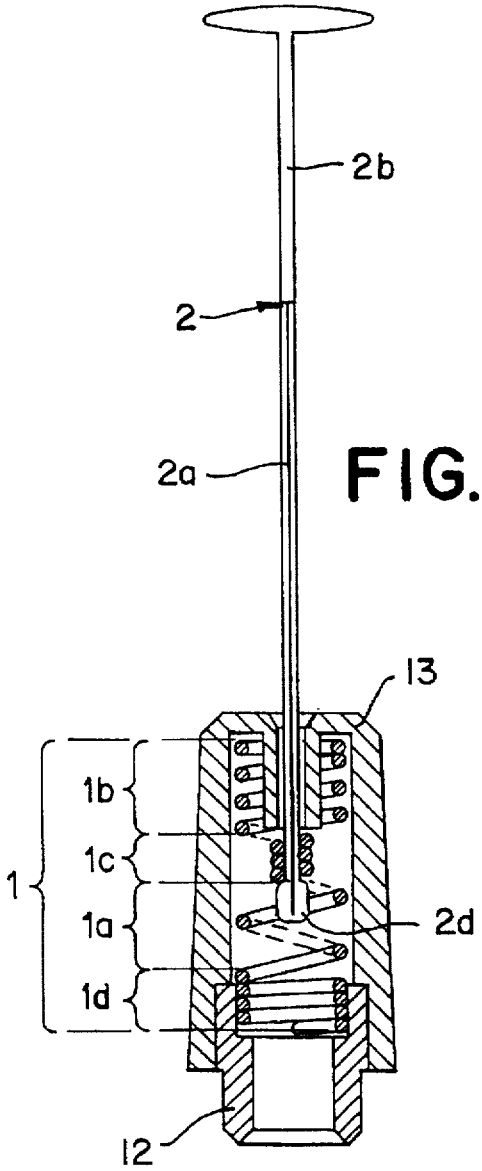
Figure 7A:
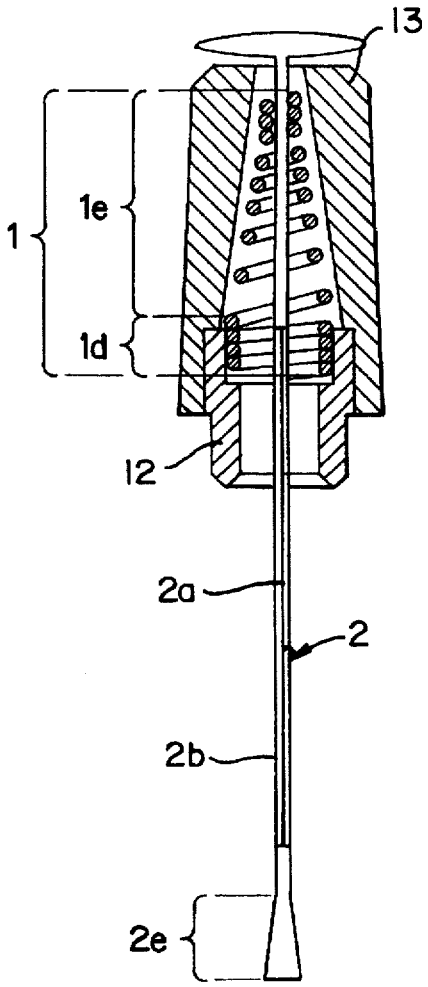
Figure 7B:
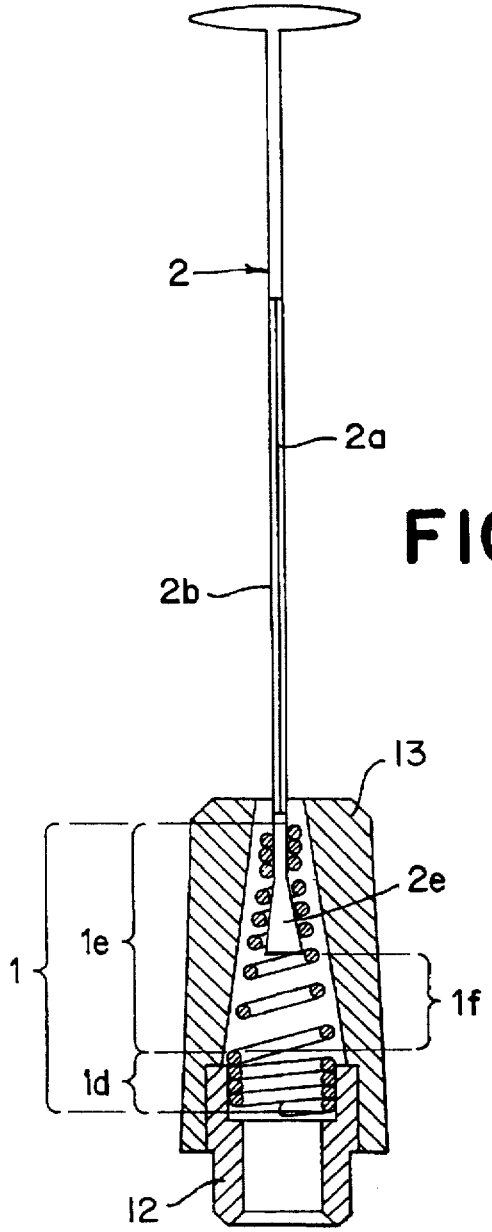
Figure 8A:
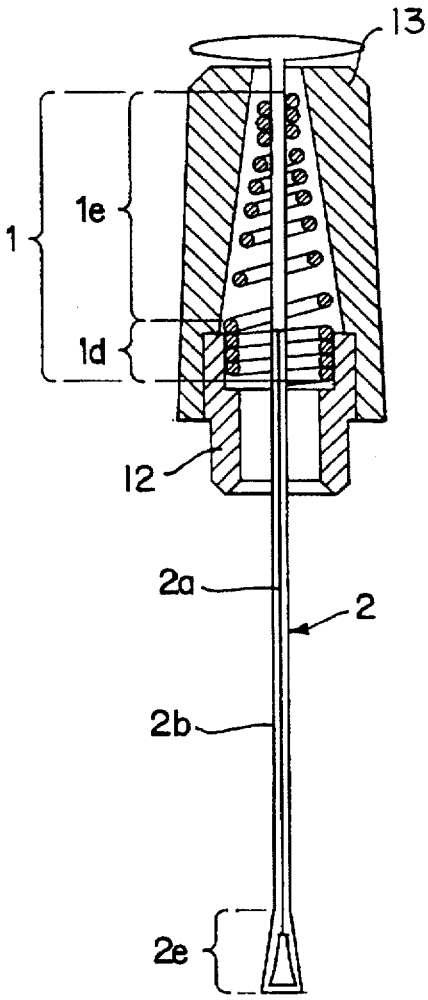
Figure 8B:
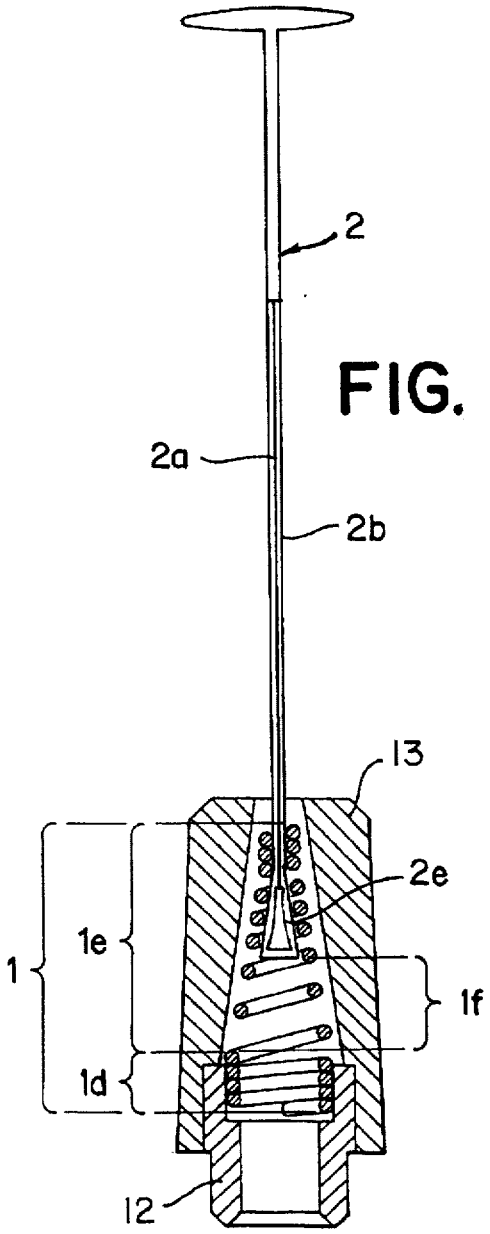
Figure 9A:
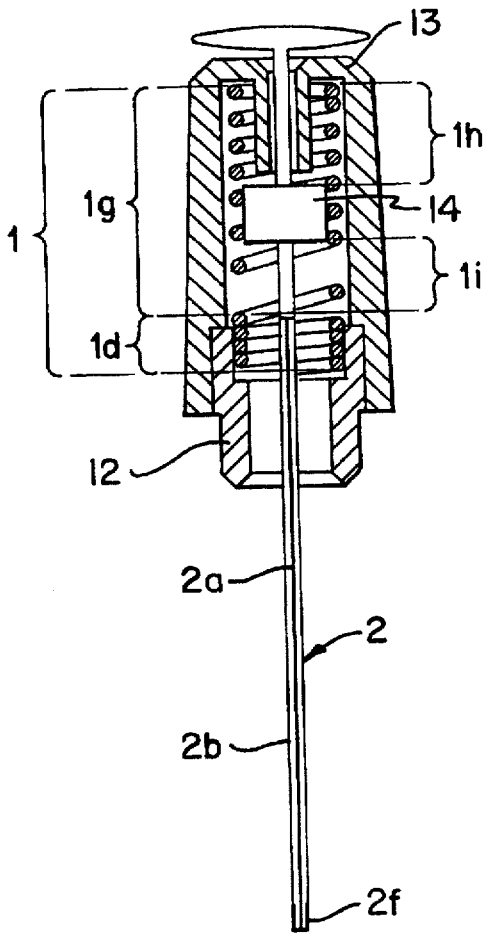
Figure 9B:
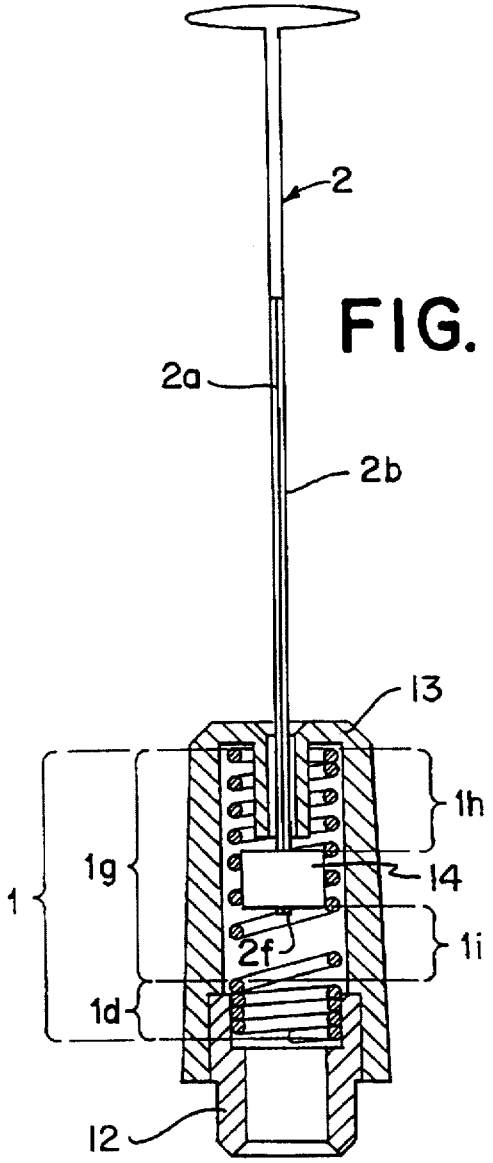

The invention is described in more detail with reference to the appended figures in which:

FIG. 1*a* presents the double-action antenna structure known from U.S. Pat. No. 5,204,687 with the antenna pulled out, FIG. 1*b* presents the double-action antenna structure known from U.S. Pat. No. 5,204,687 with the antenna retracted, FIG. 2*a* presents the double-action antenna structure known from patent publication WO 92/16980 with the antenna pulled out, FIG. 2*b* presents the double-action antenna structure known from patent publication WO 92/16980 with the antenna retracted, FIG. 3*a* presents the double-action antenna structure known from patent publication WO 94/10720 with the antenna retracted, FIG. 3*b* presents the double-action antenna structure known from patent publication WO 94/10720 with the antenna pulled out, FIG. 4*a* presents the double-action antenna structure known from U.S. Pat. No. 4,868,576 with the antenna retracted, FIG. 4*b* presents the double-action antenna structure known from U.S. Pat. No. 4,868,576 with the antenna pulled out, FIGS. 5*a* and 5*b* present one embodiment of the antenna structure according to the invention with the antenna retracted and with the antenna pulled out, FIGS. 6*a* and 6*b* present a second embodiment of the antenna structure according to the invention with the antenna retracted and with the antenna pulled out, FIGS. 7*a* and 7*b* present a third embodiment of the antenna structure according to the invention with the antenna retracted and with the antenna pulled out, FIGS. 8*a* and 8*b* present a fourth embodiment of the antenna structure according to the invention with the antenna retracted and with the antenna pulled out, FIGS. 9*a* and 9*b* present a fifth embodiment of the antenna structure according to the invention with the antenna retracted and with the antenna pulled out.

FIGS. 5*a*, 5*b*–9*a*, 9*b* present the double-action antenna structure according to the invention, comprising a helix part 1 and a rod part 2. Helix part 1 is galvanically connected to the antenna port of the transceiver part of the radio communication set, or to the antenna-impedance matching circuit (not shown in the figures), through connecting part 12 made of conducting material, which also connects the antenna structure mechanically to the radio communication set (not shown in the figures). Enveloping helix part 1, protective cover 13 made of elastic material is provided, protecting helix part 1 and the juncture between the helix part and connecting part 12. Both the connecting part 12 and the protective cover 13 comprise, in the middle thereof, a hole in the direction of the symmetry axis of the structure, where the rod part 2 can be moved in the direction of the symmetry axis.

In the embodiments presented in FIGS. 5*a*, 5*b* and 6*a*, 6*b* the cylindrical coil conductor comprising helix part 1 is wound in different ways at different points thereof. The lowest turns are wound at a slight angle, whereby they form a thick supportive spiral 1*d* to provide a firm correction between helix part 1 and connecting part 12. Since the galvanic contact between connecting part 12 and supportive spiral 1*d* short circuits these turns, they do not belong to the actual radiating helix element which consists of three parts 1*a*, 1*b*, and 1*c* in the embodiment of FIGS. 5 and 6. The lowest part 1*a* is wound at a fairly loose ascending angle. Above that, there is part 1*c* of a smaller diameter and ascending angle, called herein a coupling thread, through which helix part 1 is coupled to the pulled-out rod part 2. The diameter of the highest part 1*b* is as large as the lowest part 1*a*, but its ascending angle is more dense. The angle in the different parts of the helix part will be dealt with later on in this text.

Rod part 2 comprises radiating rod element 2*a* made of conducting material, and dielectric protective material 2*b* which covers it and is preferably made wider at the upper end thereof for a good grip. In the embodiment of FIGS. 5*a* and 5*b*, a bushing-like widening 2*c* made of conducting material is provided at the lower end of rod element 2*a*, forming a galvanic contact between the lower end of rod element 2*a* and coupling thread 1*c* of the helix part when rod element 2 has been pulled out so far that said widening 2*c* touches coupling thread 1*c*. In the embodiment of FIGS. 6*a* and 6*b*, protective dielectric material 2*b* of the rod part is made wider at the lower end thereof so that rod part 2 cannot be pulled completely through coupling thread 1*c*. In this embodiment, the coupling between the lower end of rod element 2*a* and coupling thread 1*c* is effected through an electromagnetic field.

In the passive position, the rod part 2 has been pushed into its lower position, i.e., inside the outer shell (not shown in the figures) of the radio set, for the most part. Its protective cover 2*b* made of dielectric material is preferably slightly longer at the upper end thereof than rod element 2*a* made of conducting material and placed inside of it, whereby conducting rod element 2*a* is completely pushed inside the radio set in the passive position and there is only dielectric material inside the radiating helix element 1*a*–1*c*. This is advantageous from the point of view of the operation of the antenna because a conducting material inside the radiating helix element, i.e., in the area between the highest and the lowest turns would have an adverse effect on the electric performance of the helix antenna. Since helix part 1 is coupled to the antenna port (not shown in the figures) of the radio set through the supportive thread 1*d* and the connecting part 12, it functions as the antenna of the radio set in the passive position.

A user can pull the rod part 2 outside the outer shell (not shown) of the radio set for the most part, whereby conducting rod element 2*a* is coupled galvanically or through an electromagnetic field, at the lower end thereof, to coupling thread 1*c* of helix part 1 in the manner described above. In this case, the radiating antenna of the radio set consists of the lowest part 1*a* of the helix element and of rod element 2*a*, which are connected in series. The arrangement can be described by saying that rod element 2*a* replaces the uppermost part 1*b* of the helix element in the active position. This position, in which rod element 2*a* participates in the operation of the antenna by emitting RF-power, is called the active position as above.

In the embodiments presented in FIGS. 5*a*, 5*b* and 6*a*, 6*b* the dimensions of the helix part 1 are specified so that, in the passive position, the electrical length of radiating helix element 1*a*–1*c* should be a fraction of the wavelength used, such as λ/4, 3λ/8, or λ/2. The length of rod element 2*a* is preferably one quarter of a wavelength. In order for the antenna-impedance matching circuit (not shown in the figures) belonging to the radio set to function properly in both the active and the passive positions, the emitting antenna has to have the same electrical length in both positions. This requires that the part of helix element 1 that is replaced by rod element 2*a* in the active position (the uppermost part 1*b* in FIGS. 5 and 6), is electrically as long as rod element 2*a*. When rod element 2*a* replaces the uppermost part 1*b* of the helix element, the electrical length of the operating antenna remains the same.

It is also possible to dimension the parts 1*a*–1*c* of the helix element and the rod element 2*a* so that, in the active position, the electrical length of the antenna formed as the serial connection of the helix element and the rod element is greater than the electrical length of the mere radiating helix element 1*a*–1*c* in the passive position. This is carried out by lengthening the rod element and/or by forming said coupling thread 1*c* exactly at the upper part of helix part 1. If the length of rod element 2*a* is kept at λ/4, helix element 1*a*–1*c* is provided with a length of λ/4 or 3λ/8, and coupling thread 1*c* is formed at the upper part of the helix part, the electrical length of the antenna in the active position will be λ/2 or 5λ/8, correspondingly. In order for the antenna-impedance matching to function properly, two impedance matching circuits (not shown in the figures) have to be made in the radio set for the active and passive positions, of which the right one is respectively selected by using, e.g., a separate switch (not shown in the figures).

In the embodiments presented in FIGS. 7*a*, 7*b* and 8*a*, 8*b* helix part 1 is designed with a similar supportive spiral 1*d* provided at its lower part, as the one described above, but the actual radiating helix element 1*e* is a conical, helical conductor with a tapering diameter and a thickening angle of ascend. Conical widening 2*e* is provided at the lower end of rod part 2, which can be made entirely of conducting material, as in FIGS. 7*a*, 7*b*, or coated with a dielectric material as in FIGS. 8*a*, 8*b*. The shape and size of widening cone 2*e* correspond to the shape and size of the inner part of conical helix part 1*e* at the upper end thereof. The antenna structure is coupled to the antenna port (not shown in the figures) of the radio set through the supportive spiral 1*d* of the helix part and the connecting part 12 in a similar way as above.

When rod part 2 is retracted, helix element 1*e* functions as the antenna of the radio set. When the user pulls the rod part 2 into the active position, the conical widening 2*e* at the lower end thereof is placed against the topmost turns of conical helix element 1*e* from the inside, short circuiting them either galvanically (FIGS. 7*a*, 7*b*) or through an electromagnetic field (FIGS. 8*a*, 8*b*). In this case, the serial connection formed by the non-short circuited turns 1*f* of the helix element 1*e* and by rod element 2*a* function as the antenna of the radio set.

In the embodiments of FIGS. 7*a*, 7*b* and 8*a*, 8*b*, the dimensions of the helix 1 and rod elements 2*a* adhere to the same principles that were described in connection with the above embodiments. If the radio set only comprises one antenna-impedance matching circuit (not shown in the figures), which should operate in an optimal way both in the active and in the passive positions, the total electrical length of helix element 1*e* has to be the same as the combined length of its non-short circuited turns 1*f* and the rod element 2*a* in the active position. If there are two matching circuits, the electrical length of the antenna can change between the active and the passive positions.

FIGS. 9*a* and 9*b* present one embodiment of the invention in which the design of helix part 1 deviates from the embodiments described above. Supportive spiral part 1*d* and the coupling through it and the connecting part 12 to the antenna port (not shown in the figure) is similar to the one above, but the diameter of radiating helix element 1*g* is constant throughout the whole length thereof. An electrically conducting body 14 is provided inside the helix element 1, dividing the helix element 1*g* into upper 1*h* and lower 1*i* parts and connecting the lower part 1*i* of the helix element and the rod element 2*a* in series in the active position, in the same way as coupling thread 1*c* presented in the embodiments of FIGS. 5*a*, 5*b* and 6*a*, 6*b*. In the passive position, rod element 2 is again retracted and helix element 1*g* functions as the antenna of the radio set. In the active position, the coupler widening or coupling sleeve 2*f* of the lower end of rod part 2 is in contact with the said conducting body, whereby the series connection formed by the lower part 1*i* of the helix element and by, rod element 2*a* functions as the antenna. The same observations arc true for the dimensions, which have been presented in connection with the previous embodiments.

Generally, if the antenna structure according to the invention is used to implement a double-action antenna whose electrical length should be the same in the active and the passive positions, rod part 2 has to replace, in the active position, a part of helix part 1 which is of the same size as its own electrical length. In light of the dimension examples (rod element λ/4; helix element λ/4, 3λ/8, or λ/2) presented above, it means that above the point where the lower end of rod part 2 is coupled to helix part 1 there has to be a part of the helix part whose electrical length is greater than, or at least as great as the part below it. This requirement is preferably met by winding the upper part of the helix part more closely, i.e., with a smaller ascending angle than in the lower part. If the desired distribution of the electrical length is achieved by making the helix more dense in this way, the diameter of the helix turn can increase, remain the same, or decrease towards the upper end of the helix part. If the ascending angle of the helix thread is kept constant throughout the entire length of the helix part, the requirement for the distribution of the electrical length can be met by increasing the diameter of the helix turn towards its upper end. Otherwise, the structure according to the invention can be used only to implement a double-action antenna which requires discrete antenna-impedance matching circuits for the active and the passive positions.

The antenna structure according to the invention is small in size and its electric performance is good. Some emitting element is continuously in connection with the antenna port of the radio set, whereby there is no danger of transmission signals reflecting back to the transceiver circuit. All the parts of the antenna structure are suitable for mass production, and no strict tolerance requirements need to be set for them, whereby manufacturing costs remain reasonaable.

The above-presented embodiments are intended to illustrate the technical implementation of the antenna structure according to the invention, and the invention is not limited to them, but it is possible, for those skilled in the art, to also implement other embodiments on the basis of the characterizing features presented in the claims. The present invention is not restricted to any particular application but can be used in antennas in different applications and on different frequencies, preferably on radio frequencies, such as the UHF and the VHF. The structure is preferably used in mobile phone antennas.

We claim:

1. An antenna structure for a radio communications set wherein said set has an antenna port for coupling to said antenna structure, the antenna structure comprising;

a first antenna part having a first end and a second end, said first antenna part being wound into a multiple turn coil, and the first end of said first antenna part being coupled to said antenna port; and a second antenna part being movable with respect to the first antenna part, said second antenna part being connected to said first antenna part at a point which is between said first and second ends and is more than one turn of the coil from either end, said second antenna part forms with at least that part of said first antenna part which is between said point and said first end, a serial connection which connects to said antenna port.

2. An antenna structure according to claim 1 wherein the electrical length of said series connected second antenna part and said at least part of said first antenna part is as great as the electrical length of said first antenna part.

3. An antenna structure according to claim 1 wherein the electrical length of said series connected second antenna part and said at least part of said first antenna part is greater than the electrical length of said first antenna part.

4. An antenna structure according to any of claims 1 to 3 wherein said first antenna part is a cylindrical coil conductor and comprises a coupling thread part in a middle part thereof, whose diameter is smaller than the rest of the cylindrical coil conductor, said coupling thread part connecting said second antenna part is connected to said cylindrical coil conductor to form said serial connection.

5. An antenna structure according to claim 4, wherein the middle part of said cylindrical coil conductor comprises a conducting connecting part through which said second antenna part is connected to said cylindrical coil conductor to form said serial connection.

6. An antenna structure according to any of claims 1–3, wherein said first antenna part is a conical coil conductor forming a helix antenna whose diameter decreases when moving further off the point connected to said antenna port.

7. An antenna structure according to any of claims 1–3 wherein the ascending angle of the turns of said wound conductor decreases when moving further from the point connected to said antenna port.

8. An antenna structure according to any of claims 1–3 wherein the ascending angle of turns of said wound conductor is constant and the diameter increases when moving further from the point connected to said antenna port.

9. An antenna structure according to claim 4 wherein the ascending angle of the turns of said cylindrical coil conductor increases when moving further from the point connected to said antenna port.

10. An antenna structure according to any of claims 1–3 wherein said second antenna part is a straight conductor forming a rod antenna.

11. An antenna structure according to claim 10 wherein said straight conductor is connected galvanically to said first antenna part to form said serial connection.

12. An antenna structure according to claim 10 wherein said straight conductor is connected through an electromagnetic field to said first antenna part to form said serial connection.

* * * * *